US006279904B1

(12) United States Patent
Huang

(10) Patent No.: US 6,279,904 B1
(45) Date of Patent: Aug. 28, 2001

(54) PINBALL MACHINE WITH SLOPING PLAYING FIELD

(75) Inventor: Sming Huang, Monmouth, NJ (US)

(73) Assignee: American Alpha Inc., Monmouth Junction, NJ (US)

( * ) Notice: Subject to any disclaimer, the term of this patent is extended or adjusted under 35 U.S.C. 154(b) by 0 days.

(21) Appl. No.: 09/588,977

(22) Filed: Jun. 1, 2000

(51) Int. Cl.[7] ..... A63F 7/02

(52) U.S. Cl. ..... 273/121 R; 273/121 A; 273/119 R; 273/119 A; 273/118 R; 273/118 A

(58) Field of Search ..... 273/118 R, 118 A, 273/118 D, 119 R, 119 A, 120 R, 120 A, 121 R, 121 A, 121 B, 109, 110

(56) References Cited

U.S. PATENT DOCUMENTS 3,224,775 * 12/1965 Ritz ..... 273/121 R
3,870,307 * 3/1975 Meyer et al. ..... 273/121 A
3,884,472 * 5/1975 Meyer ..... 273/121 R
3,963,241 * 6/1976 Meyer ..... 273/121 R
4,015,847 * 4/1977 Myers ..... 273/121 R
4,030,555 * 6/1977 Boyce et al. ..... 273/121 A
4,046,380 * 9/1977 Goldfarb et al. ..... 273/119 R
4,176,844 * 12/1979 Ryan et al. ..... 273/121 A
4,650,190 * 3/1987 Geiger ..... 273/121 A
5,112,049 * 5/1992 Borg ..... 273/119 A
5,607,155 * 3/1997 Cambell ..... 273/118 R

* cited by examiner

*Primary Examiner*—Raleigh W. Chiu
(74) *Attorney, Agent, or Firm*—John Lezdey & Asso

(57) ABSTRACT

The present invention provides a pinball machine having downward and side sloping playing field and a plurality of slots at the bottom of the playing field. The slots have sensor which can be selectively activated to detect the presence of a ball so as to register a score. Bumpers are also provided to translate a ball throughout a plurality of locations on the playing field.

10 Claims, 3 Drawing Sheets

PINBALL MACHINE WITH SLOPING PLAYING FIELD

FIELD OF THE INVENTION

The present invention relates to a pinball machine having a downward and side sloping playing field, and having a plurality of slots at the bottom of the playing field, which change in value according to a program. More particularly, the slots contain one or more slots which sense entry of a ball so as to register a score.

BACKGROUND OF THE INVENTION

Pinball machines have numerous configurations that are well known in the art. It is conventional practice in a pinball machine apparatus to modify the structure on the game surface, the design and the score value of different targets in order to revive the incentive of practiced players without changing the principal of the game.

There are many commercially available pinball machines that incorporate various scoring indicators, lights, graphics and sound. These machines include mechanical three-dimensional figures that communicate visually and audibly with a player.

U.S. Pat. No. 5,112,049 to Borg, which is herein incorporated by reference, discloses a pinball machine wherein a section of the playing field is changed by rotating the section to expose different components.

U.S. Pat. No. 5,405,142 to Arad, which is herein incorporated by reference, discloses a pinball machine having provisions for translating a ball in play throughout a plurality of locations. There is also provided an audio system to provide a speaking effect in response to different play conditions.

SUMMARY OF THE INVENTION

According to the present invention, there is provided a pinball machine having a slanted playing field and a plurality of playing slots arranged at the bottom of the playing field. The slots are provided with sensors for detecting a ball that enters the slot. A microprocessor is provided, which can activate at least one slot to record a score and change which slot is activated or deactivated so as to alter the playing of the game. Means are provided on the playing field to translate a ball in play throughout a plurality of locations thereon.

Advantageously, audio means are provided in association with the microprocessor for providing speaking and/or sound or light effects in response to different play conditions.

The playing field may optionally be tilted to a side wall so as to provide a double slope either mechanically or manually.

There may also be provided a three dimensional figure, which responds to a play on the field.

It is therefore an object of the invention to provide a pinball game apparatus, which changes in scoring strategy at low cost.

It is a further object of the invention to provide a pinball game apparatus, which alters the playing field to challenge the skill of the user.

It is yet another object of the invention to provide visual and sound effects, which respond to the playing conditions.

It is a further object of the invention to allow a player to alter the playing field according to a programmed selection.

DESCRIPTION OF THE PREFERRED EMBODIMENTS

Figure 1:
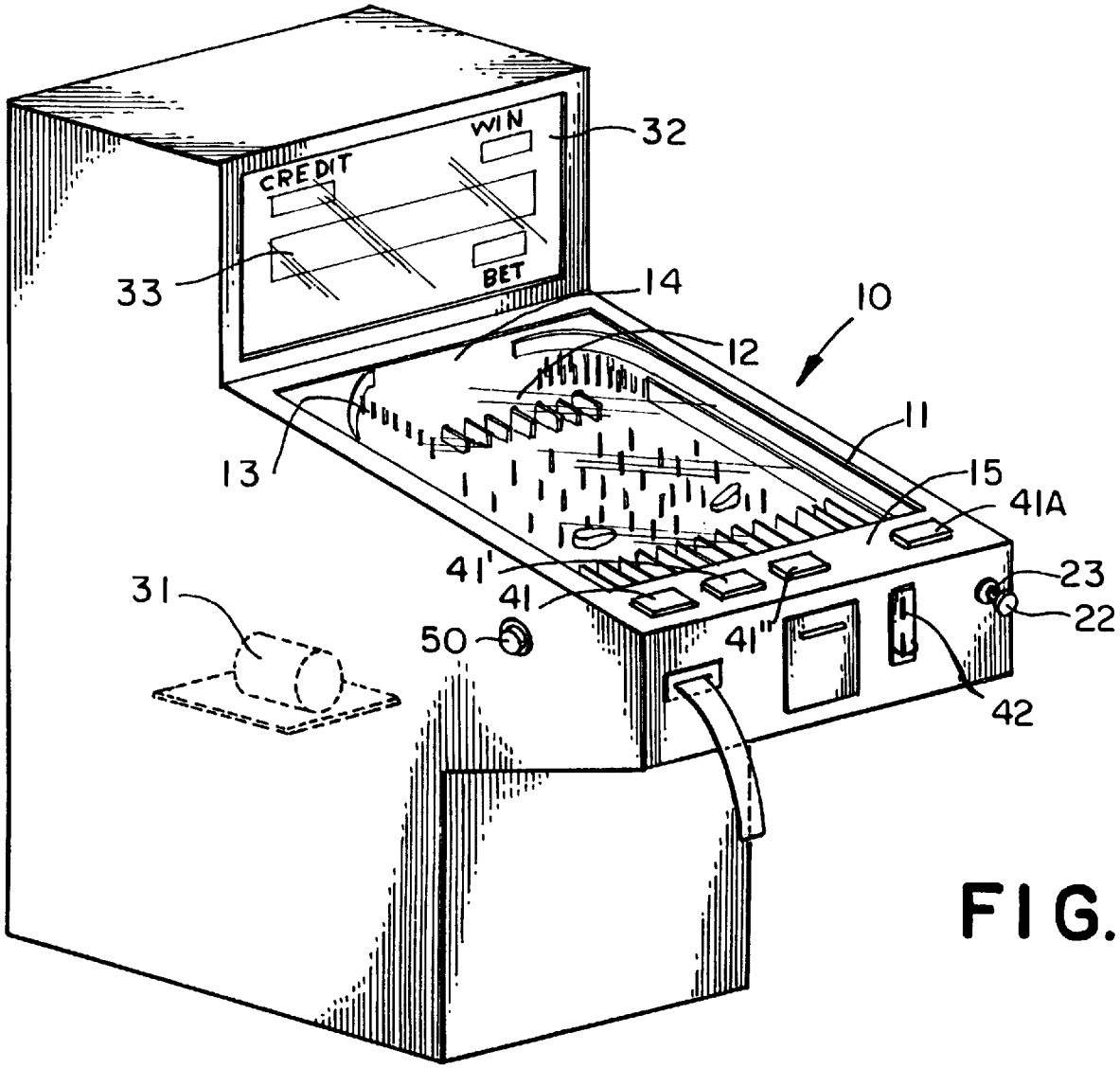
Figure 2:
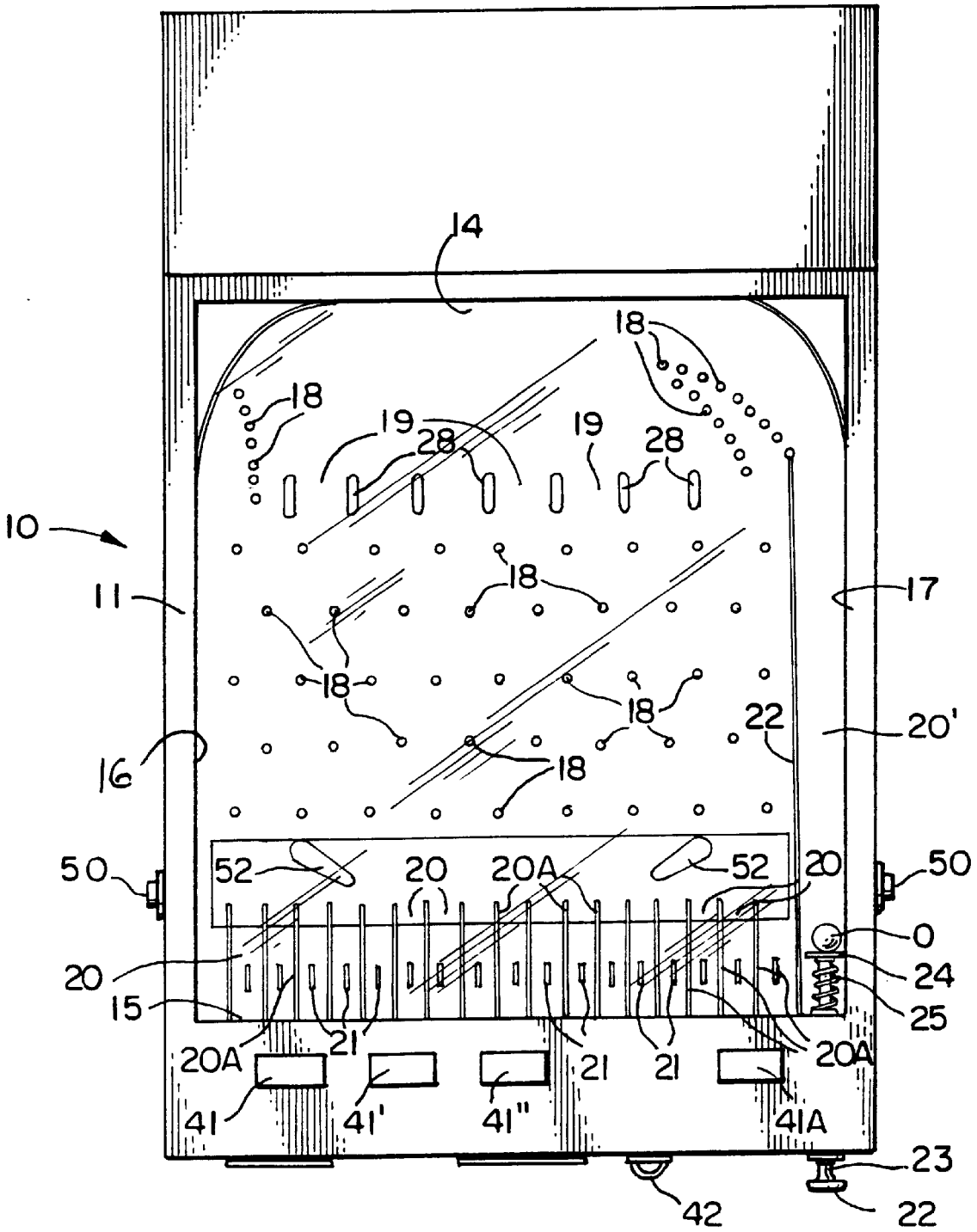

As seen in FIGS. 1 and 2, in the simplest form of the invention there is provided a pinball apparatus 10 comprising a housing 11 having an upper face 12, which form the playing field. The playing field is conventionally covered by a transparent glass pane 13.

The housing 11 is defined by a first or top wall 14, a rear wall 15 and side walls 16 and 17. The playing field 12 is inclined downwardly toward the rear wall 15 so that a ball will roll downwardly because of gravity. According to the invention, the playing field also can be inclined toward one of the sides 16 and 17 by up to about 10 degrees. This incline to one of the sides can be permanent or variable by selection of a microprocessor or manually by the player.

The playing field has a plurality of path altering pins 18 to accommodate various ball path-altering provisions. The playing field may also contain first ball path altering slots 19 formed by walls 28. The pins 18 may also comprise various fixed and elastic, active and passive targets as common in the game.

Along the bottom wall 15 there is a second plurality of slots 20, formed by walls 20A, which contain sensors 21 that can sense a ball entering one of the slots 20.

A ball launch guide 20', is disposed near one side of the housing 11. Launch guide 20' is bound by a wall 22 which is offset a nominal distance from side wall 17 to form a ball launching channel. A spring loaded pull knob 23 having a grasping handle 22, ball contact end 24, and an intermediate body having a compression spring 25, is collinearly mounted through housing 11 along the longitudinal extent of launch guide 20'. When knob 23 is fully extended, ball 0 exits launch guide 20', and is first expelled by releasing knob 23. Once ball 0 exits launch guide 20', it is in play and may come into contact with wall 14, pins 18 and enters first slots 19. The object of the game is to enter into a selected slot 20. Each slot 20 is provided with a sensor 21, which is associated with a microprocessor that contains a program which activates or deactivates a sensor 21 in one or more of the slots 20 with each game so that the player would be required to alter his playing strategy with each game. In addition, the microprocessor provides each slot 20 with a value so that the same score will reflect the player's skill in being able to enter a given slot 20.

Along the upper part of the housing 11 and along the top wall 14 is a display board 32, which is associated with a microprocessor to provide the score and a visual display on screen 33 in accordance with the play on the playing field and the sensors 21 activated by a ball 0. At least one sensor 21 provides a bonus score and is displaced by an LED. The microprocessor is also programmed to deactivate a sensor 21 so that when the ball enters a deactivated slot, the play is lost. The microprocessor is further programmed to count the number of balls 0 which enter the slot so that the odds are changed and the player must develop a different strategy. If the ball 0 rests on a lighted slot, the sensor signals the microprocessor, which senses the display board 32 and displays the cumulative score. Generally, there are sixteen slots 20 on the playing field and at least four of the slots 20 are activated and lit by an LED so as to display a slot that allows scoring.

Along the playing field are a plurality of pins 18, which randomly direct the ball to slots 19 and 20. The size and shape of the pins as well as their positioning on the playing field have an effect on the ball and the odds of a ball going to a specific slot.

Figure 3:
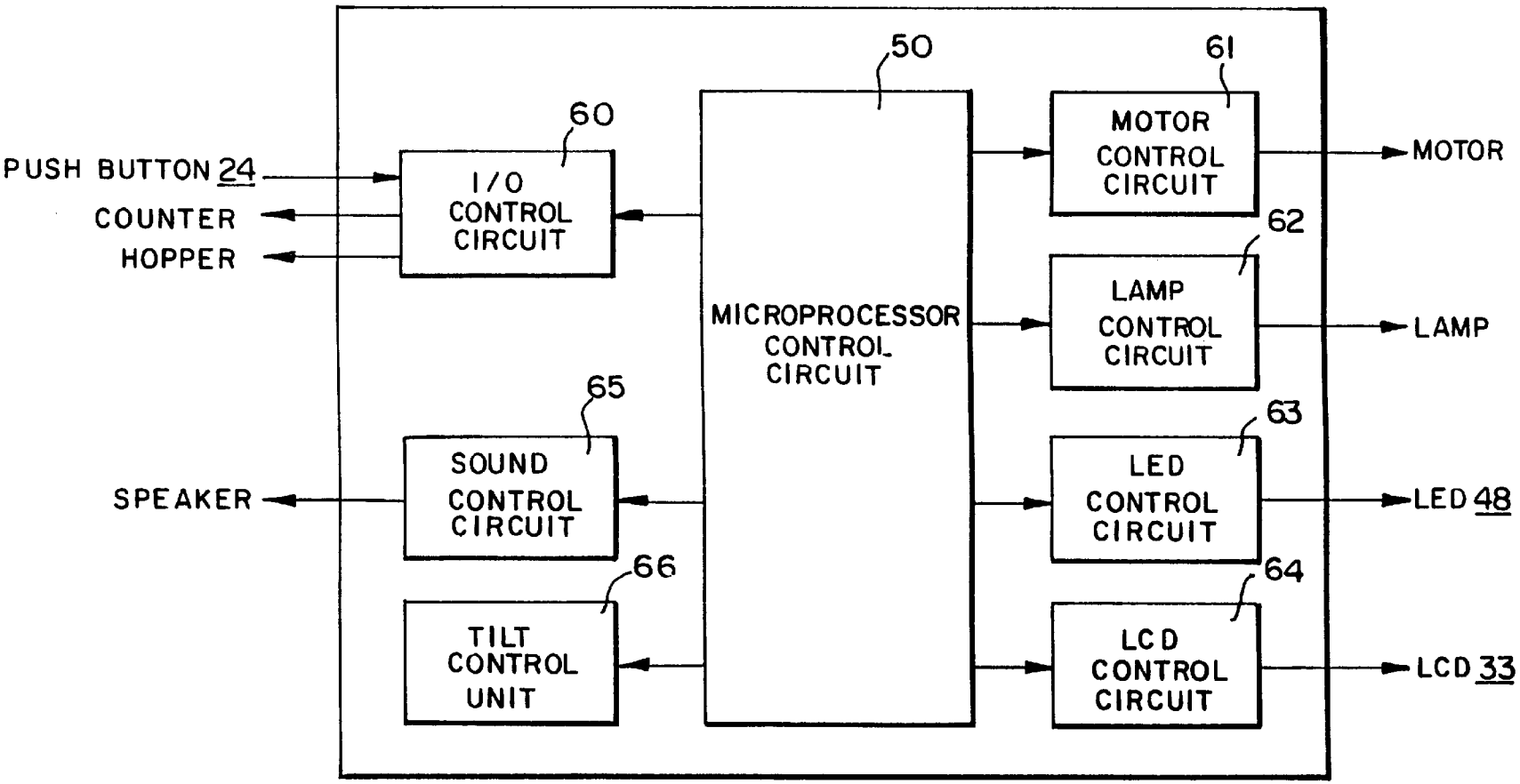

FIG. 3 is a block diagram showing a configuration according to the present invention wherein a microprocessor or CPU 50 is a memory device in which every processing program is stored. CPU 50 controls the LCD display 42, a coin insertion and detection unit 60 for detecting the insertion of a coin and includes a coin payout unit for paying out coins upon activation of button 24.

The CPU has a motor control unit 61 which controls the activation of the sensors 21, a lamp control unit 62 which illuminates the apparatus upon insertion of a coin, a LED control unit 63 for the LED's 48 of the sensors 21 and other illuminations, a LCD control unit 64 for the video display 33 which also contains a graphic RAM for storing graphic data to be sent to the video display 33 and a character ROM in which character data are stored, and a sound control unit 65 which stores sounds for different activities on the video display 33.

Upon inserting a number of coins into the slot 42 prior to playing the game, a sensing means senses the coins inserted so as to provide pulse signals corresponding to the number of coins which are transmitted to and counted by detection unit and by pressing buttons 41A, a signal is sent to activate the reel control unit 61 which provides a signal to the microprocessor to activate the game.

In accordance with a further aspect of the invention, the playing field can be tilted to the right side or left side. A mechanism such as a step motor 31 is mounted on the underside of the playing field surface. The motor 31 can be operated manually by the player or as part of the program within the CPU 50.

The game need not be limited to enter the slots 20 for scoring. The playing field may be provided with active and/or inactive pins and bumpers which not only provide scoring but activate a video or sound program. The balls 0 as they roll down the inclined plane randomly bump into pins or bumpers to deflect the path of the ball. At the bottom of the playing field here may be provided thrust levers or flippers 52 controlled by buttons 50 which can put the ball 0 back into play for additional scoring or direction. The length of the flippers can be as conventionally used in pinball apparatus.

The playing field at the back wall is provided with a gutter or return mechanism which is conventional in the art. One such mechanism is described in U.S. Pat. No. 5,464,213 which is herein incorporated by reference.

The game is played in a manner similar to known pinball machines. In the preferred embodiment the general rules are as follows: The player gets five balls, 30 per game. Scoring is made by having a ball enter into one of lit or activated slots 20. The game can be started by placing coins into slot 42 whereby coin insert and detection unit 60 signals the CPU50. The CPU50 has a control unit which illuminates the game board by LED's, an LCD for visual display and the audio units.

The player selects the desired odds by pressing button 41. These odds are displayed on the display 33 together with activation, or lighting the select number of slots 20, a play button 41A is pressed to lock in the odds. The start button 41" which causes the release of a ball 0 into launch channel 20'. Optionally, button 41" controls the slope of the game field to the right or left. However, it is understood that the slope to either side may be permanent.

The ball 0 is put into play by extending and releasing knob 32. The ball in play can be controlled by the skill of the player in being able to control the direction of the ball by a controlled vibration of the machine. Optionally, a tilt mechanism 66 may be provided to control the degree of vibration. If the tilt detector is activated the game is over.

The ball 0 travels downward toward the back wall 15 so as to enter one of the slots 20 and activate one of the sensors 21 which are lit. According to the game, either initial failure to enter an activated slot terminates the game or registers no score and permits play of the remaining balls 0. If the ball enters an activated slot, the CPU senses the display and displays the cumulative score.

The projected images and sounds can be triggered b one or more targets or pins 18 which are electrically connected with the CPU50 to trigger a image or sound upon impact with a ball 0. There may be provided a projector (not shown) which comprises a cassette with an endless film which cyclically produces an image on the display. There is further the possibility to trigger image reproduction and sound or change when two or more targets have been hit, whether in a predetermined or random sequence.

The player may choose to continue to play based on the cumulative score or he may choose to pay out. The machine may be programmed to dispense tickets or coins.

Within the housing there can be a step motor 31 associated with the playing field so as to tilt the playing field to one of the sides 16, 17.

While the invention is susceptible to various modifications and alternative forms, specific embodiments thereof have been shown by way of example in the drawings and will herein be described in detail. It should be understood, however, that it is not intended to be limited to the particular embodiments shown, but on the contrary, the intention is to cover all modifications, equivalents and alternatives falling within the spirit and scope of the appended claims.

What is claimed is:

1. In a pinball machine with a housing having a top wall, a rear wall and a pair of side walls and of which the upper face is designed as a playing area, said housing having means for translating at least one ball throughout a plurality of locations therein, means for selectively scoring points responsive to play action and means for displaying said points responsive to said play action, the improvement which comprises that said play area is inclined downwardly so that a ball will roll downwardly because of gravity and inclined toward one of the side walls, and a plurality of slots about the rear wall, said slots having a means for sensing said balls in communication with said means for scoring, whereby at least one slot contains a selectively activated sensor to communicate entry of a ball to provide a score.

2. The pinball machine of claim 1 wherein said means for scoring comprises a microprocessor.

3. The pinball machine of claim 1 wherein the playing area is manually inclined toward a side wall up to about 10 degrees.

4. The pinball machine of claim 1 wherein the inclination to a side wall is variable.

5. The pinball machine of claim 4 wherein motor means in association with a microprocessor varies the inclination to a side wall.

6. The pinball machine of claim 1 wherein said slots are selectively activated to sense a ball.

7. The pinball machine of claim 1 including a tilt detector.

8. The pinball machine of claim 2 including flipper means for flipping a ball.

9. The pinball machine of clam 1 comprising up to 16 slots containing sensing means.

10. The pinball machine of claim 9 including means for providing a visual display and sound when a ball enters a selected slot with an activated sensing means.

* * * * *